US006068256A

United States Patent [19]

Slutskiy et al.

[11] Patent Number: 6,068,256

[45] Date of Patent: May 30, 2000

[54] PIEZOELECTRIC CONVEYING DEVICE

[75] Inventors: Imanuil A. Slutskiy, Far Rockaway, N.Y.; Alexandr I. Slutcky, Tel Aviv, Israel

[73] Assignee: Technology Commercialization Corp., New York, N.Y.

[21] Appl. No.: 09/362,139

[22] Filed: Jul. 28, 1999

[51] Int. Cl.[7] ..... B65H 5/00

[52] U.S. Cl. ..... 271/264; 271/275; 271/314

[58] Field of Search ..... 271/264, 272, 271/275, 314; 310/323, 322, 321, 320, 325, 326, 327, 311

[56] References Cited

U.S. PATENT DOCUMENTS

| | | | |
|---|---|---|---|
| 3,747,921 | 7/1973 | Knappe | 271/54 |
| 4,019,073 | 4/1977 | Vishnevsky | 310/8.2 |
| 4,672,256 | 6/1987 | Okuno | 310/323 |
| 4,736,129 | 4/1988 | Endo | 310/323 |
| 4,955,598 | 9/1990 | Hiroshige | 271/267 |
| 4,997,177 | 3/1991 | Mori | 271/267 |
| 4,999,536 | 3/1991 | Toda | 310/323 |
| 5,062,622 | 11/1991 | Kataoka | 271/270 |
| 5,065,999 | 11/1991 | Kataoka | 271/265 |
| 5,071,113 | 12/1991 | Nakamura | 271/267 |
| 5,085,423 | 2/1992 | Nishimoto | 271/266 |
| 5,094,444 | 3/1992 | Seki | 271/267 |
| 5,132,582 | 7/1992 | Hayashi | 310/323 |
| 5,149,080 | 9/1992 | Yamamoto | 271/265 |
| 5,176,376 | 1/1993 | Igaki | 271/267 |
| 5,211,390 | 5/1993 | Igaki | 271/250 |
| 5,233,258 | 8/1993 | Myoga | 310/323 |
| 5,244,202 | 9/1993 | Nishimoto | 271/251 |
| 5,348,287 | 9/1994 | Yamamoto | 271/267 |
| 5,499,808 | 3/1996 | Nishimoto | 271/267 |
| 5,548,176 | 8/1996 | Oda | 310/328 |
| 5,631,517 | 5/1997 | Kato | 310/323 |
| 5,642,949 | 7/1997 | Yamamoto | 400/322 |

OTHER PUBLICATIONS

J. Wallaschek. Piezoelectric Ultrasonic Motors. Journal of Intelligent Material Systems and Structures, vol. 6, Jan. 1995, pp. 71–83.

*Primary Examiner*—David H. Bollinger
*Attorney, Agent, or Firm*—Boris Leschinsky

[57] ABSTRACT

A piezoelectric sheet conveying device of a linear contact type contains a pair of rollers containing the sheet therebetween. The first roller is driven by a piezoelectric vibrator forming a contact line between the edge insert of the vibrator and the outer surface of the first roller. The vibrator is urged against the first roller by a bias spring. The hardness of the edge insert of the vibrator is about $5\times10^7$ N/cm$^2$ and much higher than the hardness of the first roller being about $2\times10^6$ N/cm$^2$. As a result, elastic compressions of the first roller are achieved during periodic elongations of the vibrator and engagements of the first roller surface. Microgroove is formed along the contact line between the vibrator and the first roller which transmits the rotational torque to the first roller and advances the sheet in a predetermined direction. Subsequent contraction of the vibrator restores the outer surface of the first roller to its initial shape. Both the first roller and the vibrator can be made as laminated structures to achieve respectively correct composite hardness and reduce the driving voltage.

20 Claims, 3 Drawing Sheets

PIEZOELECTRIC CONVEYING DEVICE

BACKGROUND OF THE INVENTION

1. Field of the invention

The present invention relates generally to a conveying device for a sheet type object such as paper sheets, thin film strips, magnetic tape, etc. More specifically, the invention relates to paper sheet feeding devices using piezoelectric or ultrasonic element as a source of a driving force. The device of the present invention can be used particularly effectively in various office equipment and business machines such as copiers, printers, facsimile, etc., especially when small size and weight are required for compactness.

2. Description of the Prior Art

Paper sheets, thin film, magnetic and other tape, and other similar thin and low weight objects, generally referred to as a "sheet" object throughout this description, are used extensively in various office equipment such as copiers, printers, video- and audio- tape recorders and players, photo- and video-cameras, etc. Conventional sheet feeding and conveying devices contained in these machines are typically based on a feed roller driven by an electrical stepper motor coupled with a gear box. Although widely used, these devices limit the opportunities for making the business machines more compact due to the complexity of such arrangement as well as the inherent size and weight of the stepper motor and associated gear box and sophisticated control electronics. Further efforts to make business machines small and light demand the use of a more simple but yet reliable sheet feeding device.

Piezoelectric and ultrasonic motors and paper sheet conveying devices are also generally known in the prior art. Occasionally, they are used to drive the feeding rollers of the device instead of a stepper motor as suggested for example in the U.S. Pat. No. 5,548,176 by Oda. Piezoelectric motors and sheet feeders offer an advantageous balance of small size, simple control electronics, good energy efficiency, and enough power for transporting such light objects as a sheet of paper. Therefore, their use in business machines as paper feeders has gained acceptance in recent years.

Two broad categories of piezoelectric conveying devices can be identified analyzing the prior art:

- devices with a "surface contact" in which the area between the piezoelectric element and the base support structure is wide so that it is the surface of the vibrating element itself that provides a firm contact with the conveying sheet and determines the direction of transporting, and
- devices with a "linear contact" in which the area between the piezoelectric element and the base roller has a small width of about 0.5 mm or less so that the rotating roller in turn feeds the sheet in a predetermined direction.

Surface contact piezoelectric sheet feeders are quite reliable in operation, typically utilize a "traveling wave" principle and contain at least one piezoelectric disk divided into appropriate sectors. In a typical document feeder, a sheet of paper is placed between the flat portion of the vibrator and a support base which can also be a piezoelectric disk by itself. The traveling wave vibrations generated in the piezoelectric disk transmit a directional force down to the paper sheet and consequently move it in a specified direction.

An example of such a design can be found in the U.S. Pat. No. 5,348,287 by Yamamoto. A pair of "running track" type vibration members are arranged in a vertical direction to form traveling waves so as to face each other. A paper sheet is placed between the vibration elements and is moved by frictional forces generated by the interaction between the vibration elements and the paper sheet itself. A paper sheet with even thickness is propelled in a predetermined direction. One of the disadvantages of this type of sheet feeders becomes apparent when a sheet of slightly uneven thickness enters the device. Due to this asymmetrical thickness, an oblique and partially sideways movement of the sheet is produced.

Another example is disclosed in the U.S. Pat. No. 5,244,202 by Nishimoto and describes a sheet feeding apparatus including a vibration member with at least one circular-arc portion for generating a traveling wave oscillations. This invention attempts to cure the uneven sheet thickness problem by providing a sheet guide preventing a sideways movement of the paper sheet.

Additional examples of this type of a sheet conveying device can be found in U.S. Pat. No. 4,672,256 by Okuno; U.S. Pat. No. 4,736,129 by Endo; U.S. Pat. No. 4,955,598 by Hiroshige; U.S. Pat. Nos. 5,062,622 and 5,065,999 by Kataoka; U.S. Pat. Nos. 5,085,423 and 5,499,808 by Nishimoto; U.S. Pat. No. 5,094,444 by Seki; U.S. Pat. Nos. 5,176,376 and 5,211,390 by Igaki; U.S. Pat. Nos. 5,348,287 and 5,642,949 by Yamamoto.

All these devices have intrinsically limited ability to accurately transport a thin sheet of paper or another similar material due to an uneven thickness, stiffness and other irregularities usually encountered in a conveying sheet. Such disturbances lead to increased power consumption, changing the feeding direction, possible scratching or other damage to the conveying sheet which in turn led to creation of various compensation devices designed to correct these problems. Overall, a practical balance between an ultra-small size and weight of the device and a feeder accuracy and low energy consumption is very difficult to achieve.

Linear contact sheet feeders resolve the problem of uneven thickness of the feeding sheet by switching from a surface contact to a line contact with the feeding sheet. Most known devices of this type contain a "standing wave" vibrational element in which the working edge of a piezoelectric member moves in a cyclical pattern and is placed in direct contact with the conveying sheet supported on the other side by a spring-biased roller or another support surface.

An example of such device is found in U.S. Pat. No. 3,747,921 by Knappe in which the document feeding device contains an electromechanical transducer transforming energy to an elastomer coupler element by producing strain waves. The coupler element transmits strain waves to the document. The oscillatory motion of the contact surface of the coupler element in cooperation with a confronting support surface defmes a document path in a selected direction.

Another example of a linear contact piezoelectric sheet feeder is found in the U.S. Pat. No. 4,997,177 by Mori. Here, a vibrating-type driving unit employing a piezoelectric device is provided for conveying a sheet object placed between a follower roller and a piezoelectric device. By selecting a friction coefficient of the roller to be greater than the friction coefficient of the driving head, a stable sheet transporting function is achieved.

Further devices of this type are proposed in U.S. Pat. No. 4,999,536 by Toda; U.S. Pat. No. 5,071,113 by Nakamura; U.S. Pat. No. 132,582 by Hayashi; and U.S. Pat. No. 5,233,258 by Myoga.

Generally speaking, linear contact conveying devices have several important advantages over the surface contact feeders: they are quite simple, more compact, have lower weight, highly energy efficient, very accurate, have favorable "start/stop" parameters, and fairly inexpensive to build.

One of the limiting factors associated with conveying devices of this type arise from the fact that the vibrating element is placed in direct contact with the conveying sheet. High reliability of operation can only be achieved with firm contact between the vibration element and the supporting roller. However, placing a sheet of paper between these two elements can cause damage to the sheet and therefore demands reducing of the contact force. The need exists therefore for an piezoelectric device which eliminates this limitation.

Linear contact piezoelectric motors are also known in the prior art. These devices contain a vibration element placed in direct contact with the turning roller. However, one traditional drawback associated with these otherwise attractive devices is their limited longevity due to the failure of the contact zone elements between the vibrating element and the roller surface after a relatively low number of working hours, leading in turn to a loss of the rotational torque and a general failure of the device. A typical example of a piezoelectric motor of this type is described in the U.S. Pat. No. 4,019,073 by Vishnevsky et al.

The need exists therefore for an improved low power sheet conveying device of the linear contact type with extended operational life. Such device would allow the utilization of all intrinsic advantages of this type of devices and therefore allow for significant reduction in the weight and the size of business machines and other general devices requiring a sheet feeding function.

SUMMARY OF THE INVENTION

Accordingly, it is an object of the present invention to overcome these and other drawbacks of the prior art by providing a novel piezoelectric conveying device of linear contact type for feeding sheet objects such as paper documents and alike.

Another object of the invention is to provide an improved piezoelectric conveying device of linear contact type with extended operational life.

Yet another object of the invention is to provide a highly energy efficient piezoelectric linear contact conveying device of reduced size and weight.

The novel conveying device of the present invention contains a pair of rollers for transporting a sheet object placed therebetween. The first roller is powered by a piezoelectric driver and engages a sheet object by friction while the second roller is passively supporting the sheet on the opposite side of the first roller.

The piezoelectric driver of the present invention engages the first roller along a narrow line extending along the axis of rotation of the first roller. In its most basic version, it contains a piezoelectric vibrator of rectangular shape polarized along its thickness and attached at one end to the device housing through an elastic insert designed to isolate the oscillations of the piezoelectric driver from the rest of the device. As can be appreciated by those skilled in the art, piezoelectric vibrator can be made of an appropriate ceramic material and can optionally be laminated. At the other end of the vibrator also known as a working end, an edge insert is placed over the vibrator along the area of linear contact with the first roller. This edge insert is made of a hard to compress and wear resistant material such as corund ceramic material or alike.

A critical element of the piezoelectric driver of the present invention is a bias member for urging the working end of the vibrator in contact with the first roller. This bias member is a spring, preferably a flat leaf metal spring, compressing the working end of the vibrator using another elastic insert designed not to interfere with the oscillations of the vibrator. The urging force of the bias member may be optionally adjusted by an adjustment screw.

The piezoelectric vibrator contacts the first roller at a contact angle which is defined as an angle between the vibrator plane and the plane tangential to the first roller along the line of contact with the vibrator. According to the present invention, this contact angle is preferably about 45 degrees.

Applying an alternating electrical current to the piezoelectric driver with a frequency close to that of a longitudinal resonance frequency of the vibrator leads to the periodic elongations and contractions of the vibrator along its length. Every elongation of the vibrator leads to engagement of a working end edge insert into a generally softer and more elastic surface of the first roller forming a line of contact. Continuing elongation of the vibrator creates a microgroove and moves this line of contact around the center of the first roller which in turn leads to a small rotational movement of the first roller. Every contraction of the vibrator disengages its working end from the surface of the first roller and returns it to initial position leaving the first roller in its slightly turned position while its surface returns to its initial shape. Another elongation of the vibrator engages the first roller again forming a line of contact and a new microgroove in a new place which turns it further in a direction of rotation.

As discussed above, linear elongation of the vibrator forms a line of contact with the first roller and in turn leads to a rotation of the first roller. At the same time, the working end of the vibrator not only moves linearly closer and away from the other end but also moves in a direction perpendicular to the plane of the vibrator causing bending oscillations of the vibrator. Since in the vicinity of the line of contact the working end is subjected to both longitudinal and bending oscillations at a frequency close to the longitudinal resonance frequency of the vibrator, both oscillations interfere with each other. Therefore, phase relationship between these oscillations is an important design parameter of the piezoelectric driver. Optimally, the frequency of oscillations should not be only close to the longitudinal resonance frequency of the vibrator but also close to the bending resonance frequency. It is typically achieved by appropriate ratio between the length and thickness of the piezoelectric vibrator.

Design principles of a linear piezoelectric motor are discussed in detail in the U.S. Pat. No. 4,019,073 which is incorporated herein in its entirety by reference. It discusses a piezoelectric motor in which both the working end and the roller are made of extremely hard materials such as ceramics or glass with Young's modulus E higher than about $2\times10^7$N/cm$^2$. In that case, the interaction between these two parts are purely frictional and the relative deformation $\epsilon$ along the line of contact does not exceed the value of 0.0001 while the absolute deformations are less than about 1 micron. As was mentioned above, such interaction leads to a premature wear of one or both parts and limits the operational life of the device.

According to the present invention, the interaction between the vibrator and the first roller is based on a contact between a hard working end of the vibrator with a Young's modulus $E_v$ in the range of between $1\times10^7$N/cm$^2$ and $10\times10^7$N/cm$^2$ and preferably about $5\times10^7$N/cm$^2$ and a generally softer and more elastic surface of the roller having a Young's modulus $E_r$ in the range of between about $0.5\times10^6 N/cm^2$ and about $5\times10^6 N/cm^2$ and preferably about $2\times10^6 N/cm^2$.

Such difference between the hardness of the working end of the vibrator and the surface of the first roller leads to a different interaction between these two parts of the device. Engagement of the hard edge of the working end of the vibrator with the first roller leads to an elastic compression of the surface to a certain predetermined depth forming a microgroove during the time when both parts move together. Subsequent contraction of the vibrator disengages both parts and the elastic surface of the first roller restores its initial shape. During the elongation/contraction cycle, the working edge of the vibrator undertakes a complex geometrical motion, trajectory of which is a result of both the frictional and elastic compression interaction between the vibrator and the roller. Should the phase shift between the longitudinal and the bending oscillations of the vibrator be about $\pi/2$, this trajectory becomes continuous and close to the shape of an oval. In addition to the friction and elastic deformation of the roller by the vibrator, a wedging effect occurs when the contact angle is about 45 degrees which can be utilized to further increase the rotational torque by about additional 30 to 40%.

In accordance with the present invention, extended operational life of the device can be achieved by ensuring the depth of compressions of the roller not exceeding its elastic limit. In that case, every compression of the roller by the vibrator is purely elastic and no permanent deformation occurs which may lead to premature wear and surface damage. Elastic materials for the roller and the main parameters of the vibrator are chosen in such a way that the relative deformation $\epsilon$ along the line of contact of the roller surface does not exceed about 0.001.

BRIEF DESCRIPTION OF THE DRAWINGS

A more complete appreciation of the subject matter of the present invention and its various advantages can be realized by reference to the following detailed description in which reference is made to the accompanying drawings in which.

DETAILED DESCRIPTION OF THE INVENTION

Figure 1:
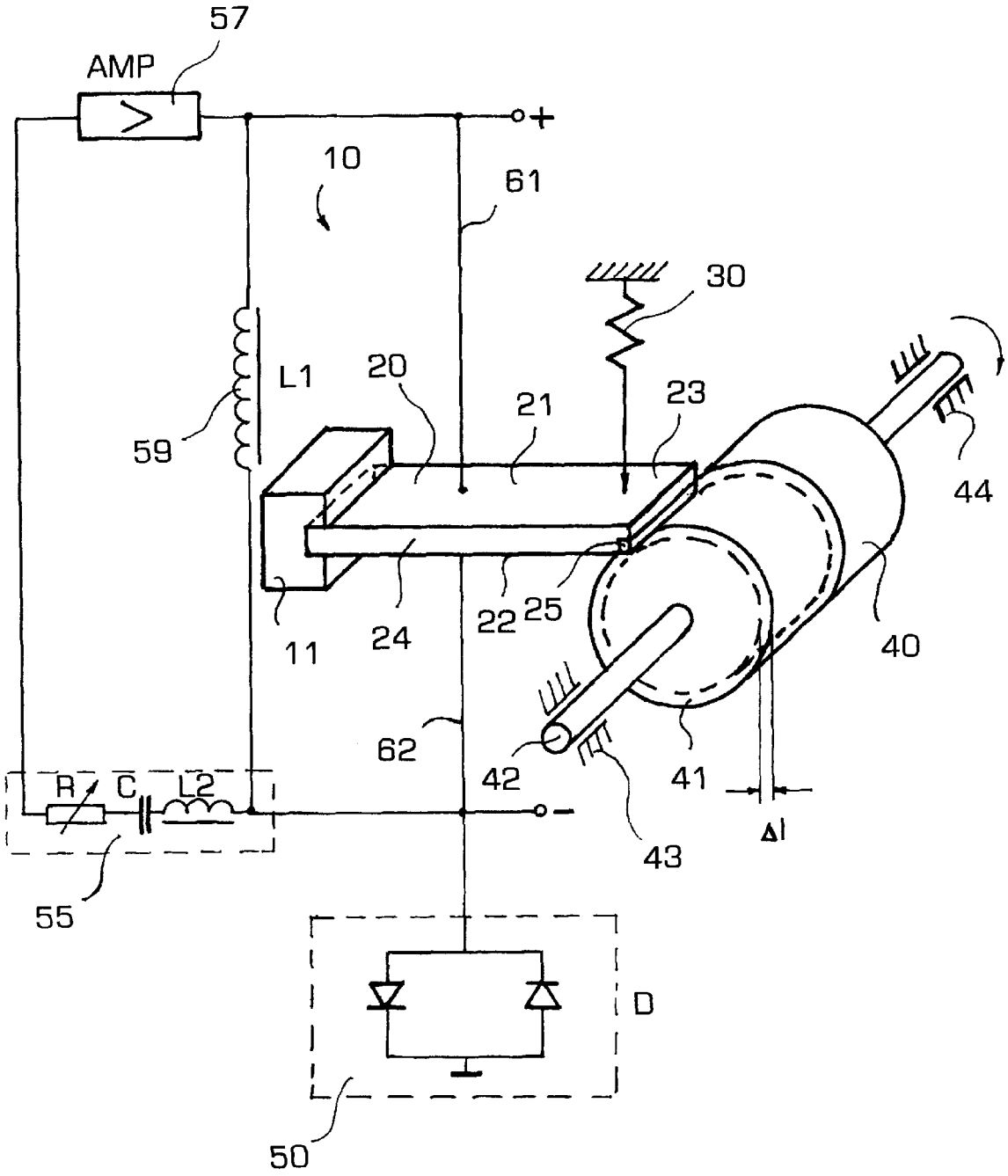
FIG. 1 is a highly schematic view of a piezoelectric driver and a first roller of the conveying device of the present invention.

A detailed description of the present invention follows with reference to the accompanying drawings in which like elements are indicated by like reference numerals.

FIG. 1 illustrates a highly schematic view of the main components of the conveying device according to the present invention: a piezoelectric driver (10) is engaged with a first roller (40). The piezoelectric driver (10) in turn consists of a vibrator (20) clamped at one end (24) through the elastic insert (11) to the housing of the device (not shown). At the other working end (23), the vibrator (20) is equipped with a hard to compress and wear resistant edge insert (25) made for example from corund or other type of ceramic or similar material. The top (21) and the bottom (22) surfaces of the vibrator (20) are designed to accept respective electrical contacts (61) and (62) of the electronic control unit supplying electrical current to cause the vibrator to oscillate. Bias element (30), typically a leaf metal spring with optional adjustment screw (not shown), is designed to urge the edge insert (25) towards the first roller (40).

In turn, the roller (40) has an external surface (41) placed in direct contact with the edge insert (25) of the piezoelectric vibrator (20). Elongation of the vibrator (20) leads to compression of the surface (41) to a predetermined depth $\Delta I$ not exceeding the elastic limit of the roller material so that the relative deformation $\epsilon$ along the line of contact of the roller surface (41) does not exceed about 0.001. A shaft (42) supports the first roller (40) and is rotatably fixed in the housing via a couple of bearings (43) and (44) allowing for free rotation of the first roller (40).

Electronic control unit contains a pair of positive and negative terminals for attaching an external electrical DC power source such as a battery (not shown) to generate the alternating electrical current with an output at a frequency close to the longitudinal resonance frequency of the vibrator. The generator automatically adjusts the output frequency using well known feed back principles. The feed back voltage is obtained from a group of diodes (50) and is transmitted to the adjustment block (55) containing a variable resistance transistor R. Changing the resistance value of transistor R leads to corresponding increase or decrease of the oscillation voltage amplitude transmitted to the amplifier (57) which in turn allows for speed adjustment of the piezoelectric driver (10). Oscillation voltage is amplified by the amplifier (57) with zero phase shift and is fed directly or through an optional voltage transformer (not shown) to the pair of electrical contacts (61) and (62) to energize the vibrator (20).

Inductive coil (59) is attached in parallel to the vibrator (20) and is designed to compensate for disturbances caused by the vibrator (20) and maintaining the zero phase shift of the feed back voltage.

In a particularly useful "start/stop" mode of operation, this control unit may be connected to an optional external switching device (not shown) to form the necessary sequence of "on" and "off" intervals in order to advance the sheet material to a predetermined distance.

Figure 2:
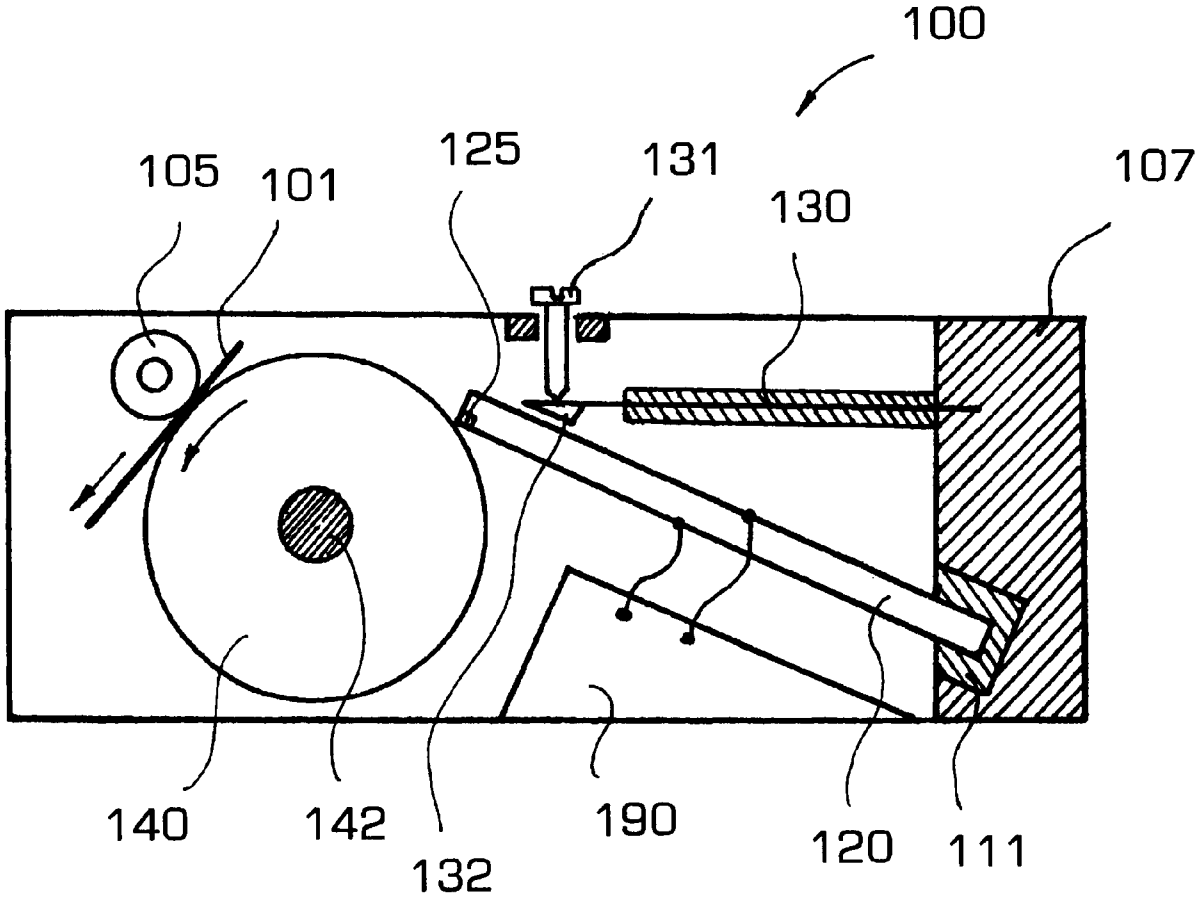
FIG. 2 is a cross-sectional view of the piezoelectric conveying device of the invention.
Figure 3:
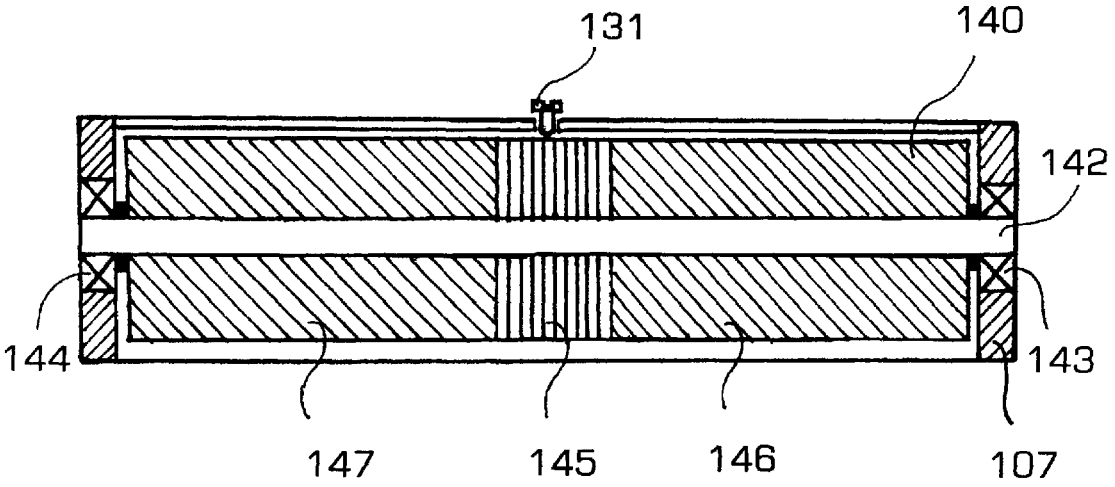
FIG. 3 is a cross-sectional view along the axis of the first roller of the conveying device.

FIGS. 2 and 3 illustrate an example of a design for a conveying device (100) based on the principles of the present invention discussed above in greater detail. Housing (107) is made preferably from a polymer material to limit the undesirable transmission of the vibrator oscillations. The housing (107) contains a pair of the first roller (140) and the second roller (105) placed opposite the first roller (140). The second roller (105) is functioning as one example of a support member for a conveying sheet (101) positioned therebetween. Other examples such as a flat surface with very low coefficient of friction are also conceived of but not shown. The first roller (140) has a shaft (142) supported by a pair of bearings (143) and (144) so that the first roller (140) can be freely rotated about the shaft (142). A piezoelectric vibrator (120) is affixed at one end to the housing (107) through an elastic insert (111). The other end is equipped with an edge insert (125) and is urged against the first roller (140) by a bias spring (130) equipped with an elastic insert (132) placed in contact with the working end of the vibrator (120). An adjustment screw (131) is designed to allow the optimization of force of the bias spring (130) against the vibrator (120). The electrical control unit (190) is attached to both upper and lower surfaces of the vibrator (120) and supplies electrical current to cause periodic elongations and contractions of the vibrator (120).

As discussed above, extended operational life of the device can be achieved by designing the edge insert (125) having substantially higher Young's modulus than the surface of the first roller (140). More specifically, the edge insert of the working end of the vibrator should be made of a material with a Young's modulus $E_v$ in the range of between $1\times10^7$N/cm$^2$ and $10\times10^7$N/cm$^2$ and preferably about $5\times10^7$N/cm$^2$ while a generally softer and more elastic surface of the roller should be made of a single or composite material having a Young's modulus $E_r$ in the range of between about $0.5\times10^6$ N/cm$^2$ and about $5\times10^6$N/cm$^2$ and preferably about $2\times10^6$N/cm$^2$.

One practical way to obtain the correct Young's modulus for the surface of the first roller is to make the first roller laminated with the use of various commonly known materials. FIG. 3 illustrates these laminations (145) which can include alternating harder and softer materials such as copper and paper or textile. In that case, the total Young's modulus of the roller can be estimated from the following equation:

$$E_r=[E_s t_s+E_h t_h]/[t_s+t_h],$$

where $E_r$ is a cumulative Young's modulus of the first roller;

$E_s$ and $t_s$ are respectively the Young's modulus and the total thickness of the softer layers, and $E_h$ and $t_h$ are respectively the Young's modulus and the total thickness of the harder layers.

Our calculations and experiments indicate that in a paper sheet conveying device the optimum design of the first roller would include a combination of evenly alternating layers of copper and paper such that the thickness of copper is at least 5 times less than the thickness of paper.

In some cases, it is not necessary to make the first roller (140) as wide as the sheet of paper (101). In fact, FIG. 3 illustrates a design of the roller having a combination of alternating layers (145) and a pair of support rollers (146) and (147) positioned on the sides of the layers (145). Support rollers may be made of a polymer material to provide adequate friction with the sheet (101).

In operation, periodic elongations of the vibrator (120) powered by the electronic control unit (190), cause the edge insert (125) to engage the surface of the roller (140) forming a temporary microgroove such that the relative deformation $\epsilon$ along the line of contact of the roller (140) stays within the elastic limits and does not exceed about 0.001. As a result, the vibrator (120) engages the roller (140) as in a gear tooth mode and rotates it about the shaft (142) causing advancement of the sheet (101) in a direction of an arrow on FIG. 2. Subsequent contraction of the vibrator (120) disengages it from the first roller (140) and returns it to its initial length while the microgroove is resolved so that the surface of the first roller (140) returns to its initial shape. Bias spring (130) urges the vibrator (120) against the first roller (140) so that during the next elongation cycle, a new microgroove is formed along the new line of contact between the vibrator (120) and the first roller (140) so the rotation of the first roller (140) continues.

Figure 4:
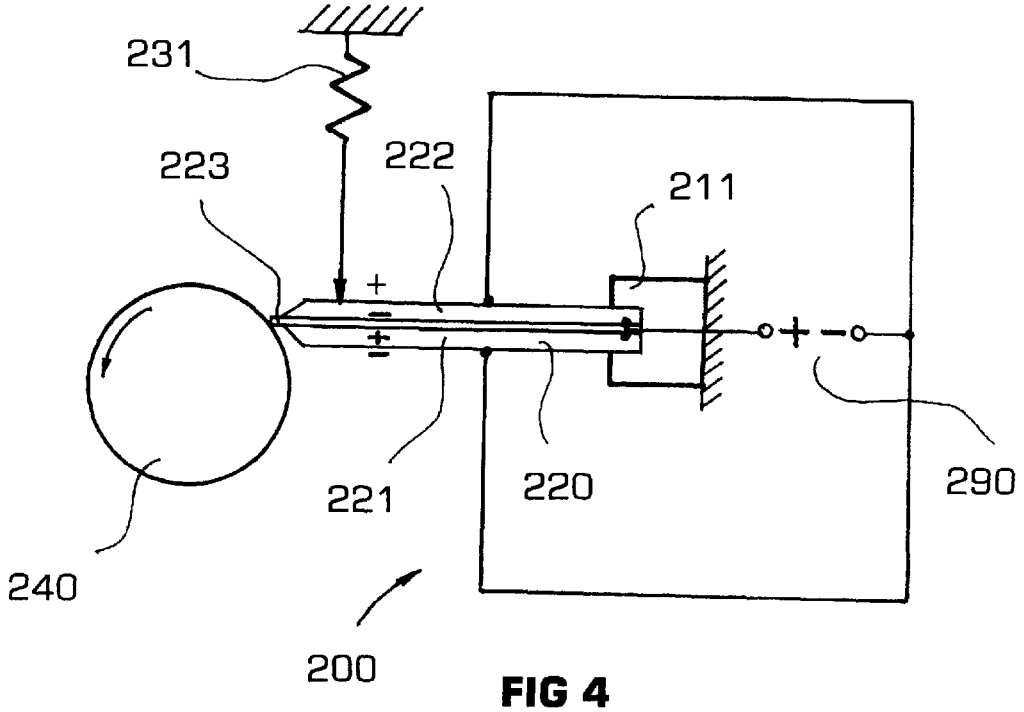
FIG. 4 is a highly schematic view of a variation of the piezoelectric driver having a laminated vibrator.

FIG. 4 illustrates a variation of a laminated design of a vibrator for a piezoelectric conveying device of the present invention. Here, the vibrator (220) is affixed at one end in the elastic insert (211) and is engaged at the other working end with the first roller (240) while being urged by a bias spring (231) and being energized by an electronic control unit (290).

The vibrator (220) consists of at least two piezoelectric elements (221) and (222) separated by a ceramic insert (223) extending beyond the length of both piezoelectric elements (221) and (222) at the working end of the vibrator (220). Electrical contacts of both piezoelectric elements (221) and (222) are connected respectively in parallel and attached to appropriate terminals of the electronic control unit (290). The edge of the ceramic insert (223) extends beyond the vibrator's piezoelectric elements and engages the first roller (240) during operation of the conveying device. The advantage of this arrangement is that the driving voltage may be reduced as a result of increased number of piezoelectric elements which is advantageous when using the independent sources of DC voltage such as electric batteries.

Although the present invention is described for a specific version of a piezoelectric conveying device, it is not limited thereto. One example of an alternate design includes a hollow first roller and a vibrator, the working end of which is placed against the inside surface of the first roller for transmitting the rotational torque from the inside rather then from the outside of the first roller as has been mostly described above. Numerous variations and modifications would be readily appreciated by those skilled in the art and are intended to be included in the scope of the invention, which is restricted only by the following claims.

We claim:

1. A piezoelectric conveying device for transporting a sheet material, said device comprising:

a support member;

a first roller positioned adjacent said support member, said first roller being in frictional contact with the sheet of material placed between said support member and said first roller;

a piezoelectric driver positioned in linear contact with and urged against said first roller, and an electronic control unit causing periodic oscillations of said piezoelectric driver, whereby oscillations of said piezoelectric driver causing rotation of said first roller and subsequent transporting of the sheet material in a predetermined direction.

2. The piezoelectric conveying device as in claim 1, wherein said support member being a second roller, said first roller having an outer surface and said piezoelectric driver positioned in linear contact with and urged against said outer surface of said first roller.

3. The piezoelectric conveying device as in claim 2, wherein said electronic control unit having drive electrodes and said piezoelectric driver comprises:

a piezoelectric vibrator affixed in a stationary position at one end and having an opposite working end positioned in linear contact with said outer surface of said first roller, said vibrator having an upper surface and a lower surface for attaching said drive electrodes of said electronic control unit; and a bias member for urging said working end of said vibrator against said first roller.

4. The piezoelectric device as in claim 3, wherein said working end of said vibrator being placed against the outer surface of said first roller at an angle of about 45 degrees.

5. The piezoelectric conveying device as in claim 3, wherein periodic non-fading oscillations of said piezoelectric driver being powered by said electronic control unit at a frequency close to a natural longitudinal resonance frequency of said vibrator.

6. The piezoelectric conveying device as in claim 5, wherein said vibrator further comprising an edge insert positioned at the working end of said vibrator in direct contact with the outer surface of said first roller.

7. The piezoelectric conveying device as in claim 6, wherein the hardness of said edge insert as characterized by a Young's modulus being between about $1\times10^7$ N/cm$^2$ and about $10\times10^7$ N/CM$^2$.

8. The piezoelectric conveying device as in claim 7, wherein the hardness of the outer surface of said first roller as characterized by a Young's modulus being between about $0.5\times10^6$ N/cm$^2$ and about $5\times10^6$ N/cm$^2$.

9. The piezoelectric conveying device as in claim 6, wherein the hardness of said edge insert as characterized by a Young's modulus being about $5\times10^7$ N/cm$^2$.

10. The piezoelectric conveying device as in claim 9, wherein the hardness of the outer surface of said first roller as characterized by a Young's modulus being about $2\times10^6$ N/cm$^2$.

11. The piezoelectric conveying device as in claim 6, wherein periodic oscillations of said vibrator causing engagements of said edge insert with the outer surface of said first roller leading to compressions of said outer surface, said compressions not exceeding natural elastic compression limit of said first roller, whereby cessation of compressions causing said outer surface to fully restore its initial shape.

12. The piezoelectric conveying device as in claim 6, wherein periodic oscillations of said vibrator causing engagements of said edge insert with the outer surface of said first roller leading to compressions of said outer surface, said compressions not exceeding natural elastic compression limit of said first roller, whereby a relative deformation of the outer surface of said first roller not exceeding about 0.001 and cessation of compression causing said outer surface to fully restore its initial shape.

13. The piezoelectric conveying device as in claim 8, wherein said first roller further comprising a composite structure having a layer of a softer material and a layer of a harder material, whereby the overall hardness of the structure is characterized by a Young's modulus being between about $0.5\times10^6$ N/cm$^2$ and about $5\times10^6$ N/cm$^2$.

14. The piezoelectric conveying device as in claim 13, wherein said softer material being paper and said harder material being copper.

15.The piezoelectric conveying device as in claim 13, wherein said softer material being textile and said harder material being copper.

16. The piezoelectric conveying device as in claim 14, wherein the total thickness of said softer layer being at least 5 times higher than the total thickness of said harder layer.

17. The piezoelectric conveying device as in claim 16, wherein said first roller further comprising support rollers, said support rollers having an outside diameter being close to the outside diameter of said composite structure, said support rollers placed adjacent to said composite structure.

18. The piezoelectric conveying device as in claim 3, wherein said vibrator further comprising a laminated structure having a first piezoelectric element having a first most upper flat surface and a second flat surface, an isolator, and a second piezoelectric element having a third flat surface and a fourth most lower flat surface, said isolator placed between said second flat surface of the first piezoelectric element and said third flat surface of the second piezoelectric element, said four flat surfaces adapted to receive corresponding driving electrodes from said electronic control unit.

19. The piezoelectric conveying device as in claim 18, wherein said isolator extending beyond said first and said second piezoelectric elements at the working end of said vibrator, said isolator positioned in direct contact with the outer surface of said first roller.

20. The piezoelectric conveying device as in claim 19, wherein the hardness of said isolator as characterized by a Young's modulus being between about $1\times10^7$ N/cm$^2$ and about $10\times10^7$ N/cm$^2$.

* * * * *